United States Patent [19]

Gernlein

[11] 4,234,107

[45] Nov. 18, 1980

[54] TUBE FILLING MACHINE HAVING AN ADJUSTABLE STROKE, CAM OPERATED PISTON

[75] Inventor: Hermann Gernlein, Karlsruhe, Fed. Rep. of Germany

[73] Assignee: Industrie-Werke Karlsruhe-Augsburg Aktiengesellschaft, Fed. Rep. of Germany

[21] Appl. No.: 41,737

[22] Filed: May 23, 1979

[30] Foreign Application Priority Data

May 31, 1978 [DE] Fed. Rep. of Germany ... 7816308[U]

[51] Int. Cl.[3] ..... G01F 11/06

[52] U.S. Cl. ..... 222/309; 74/834; 92/13.7; 222/380; 417/519

[58] Field of Search ..... 222/216, 305, 306, 307, 222/308, 309, 372, 380; 74/45, 522, 834; 141/147, 152; 417/519; 92/13.7

[56] References Cited

U.S. PATENT DOCUMENTS

| | | | |
|---|---|---|---|
| 2,032,163 | 2/1936 | Bagby | 222/309 X |
| 2,245,287 | 6/1941 | Minard | 222/309 X |
| 2,503,907 | 4/1950 | Hefler | 92/13.7 X |
| 3,443,521 | 5/1969 | Stender | 92/13.7 X |
| 3,496,874 | 2/1970 | Findlay | 74/834 X |

*Primary Examiner*—David A. Scherbel
*Assistant Examiner*—Fred A. Silverberg
*Attorney, Agent, or Firm*—McGlew and Tuttle

[57] ABSTRACT

A tube filling and closing machine includes a material feeding device which comprises a container for the material to be packaged which opens into a cylinder in which a piston is movable backwardly and forwardly for taking in the material from the container and discharging it out through a nozzle discharge into a package to be filled. The piston is moved by a connection to a piston rod which is connected to the piston and a valve is disposed between the filling line to the storage container for the material and a discharge line to a nozzle for filling the package. A mechanism is connected to the piston to change the stroke thereof for varying the quantity of material which is filled and this includes a lever arm which is connected to a fixed pivot at one end and its opposite end provides a journal for a rotatable shaft which carries a cam plate which is in engagement with a cam roller located at a fixed location. The cam plate drives a connecting rod by an eccentric or crank connection which is connected at the one end of a link which has its opposite end connected to the piston rod. A pivot bearing embraces the link and is movable therealong and it carries a pivot pin for a bearing block which may be adjusted by a threaded spindle for the purpose of varying the stroke of the piston. In an alternative embodiment, the shaft for the cam plate is mounted in a slide bearing.

2 Claims, 2 Drawing Figures

TUBE FILLING MACHINE HAVING AN ADJUSTABLE STROKE, CAM OPERATED PISTON

FIELD AND BACKGROUND OF THE INVENTION

This invention relates to packaging machines in general and, in particular, to a new and useful packaging machine which includes a piston which is movable in one direction to take in a dosage of material and, in an opposite direction, to discharge the material and, wherein, there is a valve connected between the fill line for the material and the discharge line for the material and which includes means for varying the stroke of the piston.

DESCRIPTION OF THE PRIOR ART

The present invention relates to a packaging machine, in particular, a tube filling and closing machine, with mechanical means for both moving a piston serving to proportion the filling material and for achieving a temporary piston stoppage in at least one of its dead centers during which there occurs the reversal (readjustment) of a rotary disc valve associated with the piston and arranged between the hopper and the piston.

In modern large scale packaging, the exact proportioning of materials to be filled is of great importance. Whether such materials are of a solid, pasty or liquid nature is secondary.

Liquid, in particular pasty materials, e.g., toothpaste, are normally packaged in tubes. For this purpose, machines for the filling and closing of these tubes are preferably used. For the purpose of transferring the material from a supply bin, e.g., a hopper or the like, into the tubes, it is known to provide the machines with a proportioning device consisting essentially of a proportioning piston. The precision of the quantity of the material to be filled depends, among other things, essentially on the precision of the proportioning device. On the other hand, however, the required cost of machinery and instrumentation must be in proper proportion to the desired result.

A known tube filling and closing machine is provided with a proportioning device of the above-mentioned kind. It consists essentially of a lever system and a cam plate. The cam plate moves a lever of a cam roller connected with a rocker arm. A sliding block is arranged in the rocker arm which is adjustable by means of a threaded spindle and a cardan shaft. Such a kinematic design effects a perfectly desirable stroke variation at the piston. In the known form of construction, it is necessary to connect the sliding block with one leg of an angle lever, while the other leg thereof is articulated to the piston.

As has been shown and will further be shown, the expense required for the operation of the known form of construction is relatively high. Thus, a rather complicated lever system is required which includes various pivot points which cause unnecessary wear. In this proposed solution, the drive force is transmitted by the cam plate to the piston through the levers with their joints. However, since the piston rod, by design, does not move in the axis of the piston, wear-causing radial forces will, of necessity, also occur on the rod. Lastly, in the known form of construction, the susceptibility to wear and the resulting wabbling joints of the conceptionally indispensable, articulated connections have an adverse effect on the proportioning precision. Apart from the fact that the known form of construction requires relatively much space, it is not very suitable for larger piston forces due to the aforementioned facts.

SUMMARY OF THE INVENTION

In consideration of the defects and disadvantages inherent in the known form of construction, the present invention provides a proportioning device of high precision, but in which the expense inherent in the lever system is appreciably reduced. At the same time, it is an object of the invention to improve the kinematic performance of the gear transmission in its dynamic parameter.

According to the present invention, this problem is solved by a cam plate in operative connection with a fixed cam roller, which is rotationally mounted in a likewise fixed lever, and is connected with a connecting rod through a crankshaft, with the connecting rod being coupled ot one end of a link, while its other end has its point of articulation at the piston rod. The link comprises a pivot bearing formed as a bushing or the like and is arranged in a movable bearing block, with a spindle associated with the block adjusting the stroke of the piston rod.

In a further appropriate development of the idea underlying the invention, the crankshaft may be mounted on a sliding block or the like.

The proposed invention is attended by a number of advantages. While completely ensuring all essential operational functions, on the one hand, and avoiding extensive lever arrangements, on the other hand, the proposed invention is relatively simple in its design as well as in its operation and is largely unsusceptible to malfunction.

By the use of a crank drive with its relatively low peak speed and acceleration in conjunction with a cam control ensuring smooth onset and end of movement of the piston, the flow resistance of the material to be proportioned is reduced in an inconsequential manner and, thereby, at the same time, increased output of the machine is ensured. Moreover, the proposed invention requires relatively little space, permitting a compact but perfectly clear construction.

Accordingly, an object of the present invention is to provide a packaging machine and, in particular, a tube filling and closing machine, which has mechanical means for both moving the piston serving for the proportioning of the material to be filled and for achieving a temporary piston stoppage in at least one of its dead center positions during which a reversal or a readjustment of a rotary valve is effected, with the valve being arranged between a hopper supply for the material to be packaged and the piston, and a discharge for the material for directing it into a package and, wherein, by a cam plate which is in operative connection with a fixed cam roller rotatably mounted in an also fixed lever and connected with a connecting rod through a crankshaft, the connecting rod being coupled to one end of a link, while the other end having a point of articulation at the piston rod and, wherein, the link comprises a pivot bearing designed as a bushing and arranged in a displaceable bearing block and which includes a spindle associated with the block for adjusting the stroke of the piston rod.

A further object of the present invention is to provide a packaging machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings ad descriptive matter in which preferred embodiments of the invention are illustrated.

DESCRIPTION OF THE PREFERRED EMBODIMENTS

Figure 1:
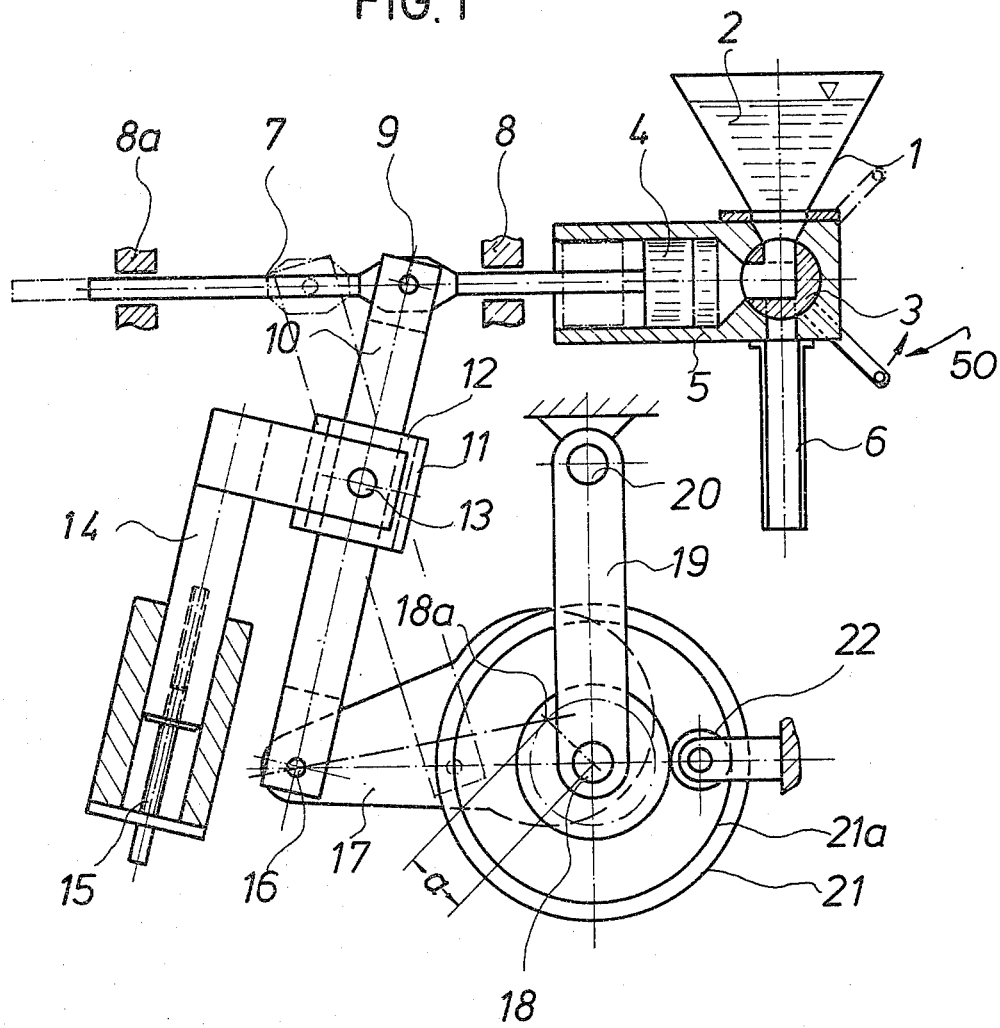
FIG. 1 is a schematic sectional view of a package or tube filling device constructed in accordance with the present invention.

Referring to the drawings in particular, the invention embodied therein, comprises, a packaging machine for packaging material 2 into a container or tube which is adapted to be fitted to a nozzle discharge 6.

The material to be packaged 2, contained in the hopper or supply container 1, is drawn into a cylinder 5 through a rotary disc valve 3 as a proportioning piston 4 is moved from right to left in the cylinder. When the proportioning piston 4 has reached its left dead center position, valve 3 is rotated counterclockwise by 90° by mechanical means 50 connected thereto. Thereby, through the return stroke of the proportioning piston 4, the material 2 previously drawn into cylinder 5 is directed to the nozzle 6 and from there into the packing material (not shown) and which consists of a tube or the like. This process repeats in synchronism with the supplied packaging materials.

To move the proportioning piston 4 in the above-described manner, the following apparatus is provided:

A piston rod 7 is mounted for axial displacement in the bearings 8, 8*a* and articulated to a link 10 by means of a stud 9. The link 10 is guided in a pivot bearing 11 by means of the bushing 12. The pivot bearing 11 is secured by its pivot pin 13 in an adjustable, i.e., displaceable, bearing block 14. By means of the threaded spindle 15, the bearing block 14, together with the pivot bearing 11, can be adjusted. Thereby, the stroke of the piston rod 7 and thus also the stroke of the proportioning piston 4 connected with it, is variable within defined limits.

Link 10 is hinged at its lower end to the connecting rod 17 by means of stud 16. The connecting rod 17 is mounted on the crankshaft 18 at 18*a*. The distance "a" between the crankshaft 18 and the point of articulation 18*a* corresponds to the crank radius. Crankshaft 18 has its rotational suspension in the arm 19 arranged in the fixed pin 20, and a cam plate 21 is firmly connected with the crankshaft 18.

The cam roller 22, which is likewise fixed, is in constant operative connection with the cam plate 21, so that the crankshaft 18, rotatable about pin 20, must give way according to the form of the cam track 21*a* of cam plate 21.

Due to the special design of the cam track 21*a*, it is possible to compensate the actually small stroke of the crank drive in the range of the two dead center positions of the crank drive over a correspondingly dimensioned angle of rotation and thus to also achieve a resting position of the link 10 together with the proportioning piston 4. Such a resting position is necessary in order to enable the displacement of the rotary disc valve 3 by a certain angle, for example, by 20°.

Figure 2:
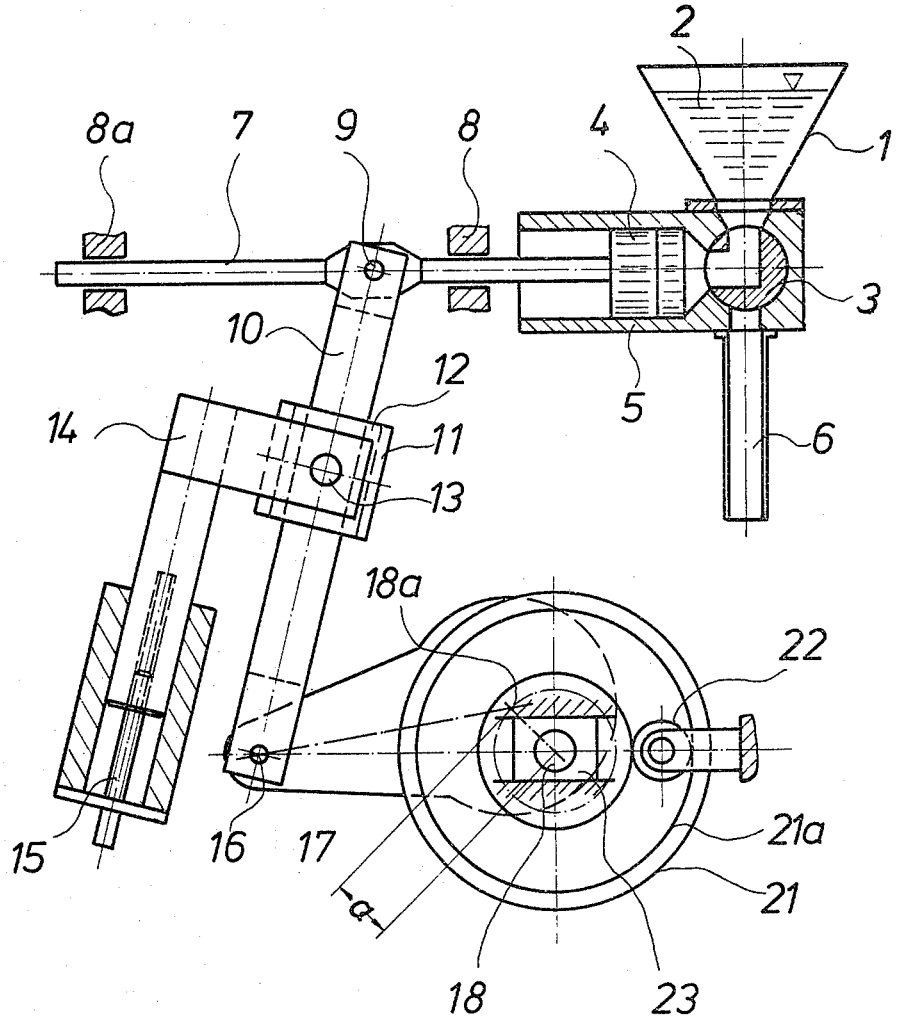
FIG. 2 is a view, similar to FIG. 1, of another embodiment of the invention.

The embodiment according to FIG. 2 is essentially identical with that of FIG. 1. However, the suspension of the crankshaft 18 on a sliding block 23 is different, whereby, a compensating stroke for the resting position of piston 4 is ensured.

While specific embodiments of the invention have been shown and described in detail to illustrate the application of the principles of the invention, it will be understood that the invention may be embodied otherwise without departing from such principles.

What is claimed is:

1. A packaging machine, comprising, a material feeding device, including a supply container for the material to be packaged, a metering cylinder having one end with a first connection to the supply container and a filling nozzle discharge second connection for discharging the material which has been drawn into the cylinder, a piston slidable in said cylinder in one direction to draw material from the container into the cylinder and in an opposite direction to discharge it through said discharge connection, a mechanically adjustable valve located between said first and second connections which is shiftable to communicate said cylinder selectively and alternatively with said first and second connections, a crank shaft, a cam plate affixed to said crank shaft for rotation therewith, an arm having one end secured at a fixed location and an opposite end rotatably supporting said crank shaft, a fixed position roller mounted alongside said cam plate in operative engagement therewith, a connecting rod having one end pivotally mounted on said plate at a spaced location from a central axis of said plate and having an opposite end, a link having one end connected to said connecting rod and an opposite end connected to a piston rod connected to the piston, a pivot bearing bushing slidable on said link, a displaceable bearing block having a part pivoted on said link and an opposite end part, and an adjustment means connected to said opposite end part of said bearing block being adjustable to vary the stroke of said piston.

2. A packaging machine, as claimed in claim 1, including slide block means rotatably supporting said crank shaft for rotation and sliding linear movement.

* * * * *